US010875297B2

(12) United States Patent
Kano et al.

(10) Patent No.: US 10,875,297 B2
(45) Date of Patent: Dec. 29, 2020

(54) IMAGE FORMING APPARATUS AND CONTROL METHOD THEREFOR

(71) Applicant: CANON KABUSHIKI KAISHA, Tokyo (JP)

(72) Inventors: Yutaka Kano, Kawasaki (JP); Yuhei Oikawa, Yokohama (JP); Toshiyuki Chikuma, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/294,335

(22) Filed: Mar. 6, 2019

(65) Prior Publication Data

US 2019/0299599 A1 Oct. 3, 2019

(30) Foreign Application Priority Data

Mar. 29, 2018 (JP) ..... 2018-065496

(51) Int. Cl.
*B41J 2/045* (2006.01)
*B41J 29/38* (2006.01)

(52) U.S. Cl.
CPC ..... *B41J 2/04563* (2013.01); *B41J 2/0452* (2013.01); *B41J 29/38* (2013.01)

(58) Field of Classification Search
CPC ..... B41J 2/04528; B41J 2/04563
USPC ..... 347/17
See application file for complete search history.

(56) References Cited

U.S. PATENT DOCUMENTS 8,783,832 B2 7/2014 Oonuki et al.
9,033,471 B2 5/2015 Oonuki et al.
2015/0343817 A1* 12/2015 Yokozawa ..... B41J 2/0454 347/17

FOREIGN PATENT DOCUMENTS

JP 2007-223144 A 9/2007

* cited by examiner

*Primary Examiner* — Lam S Nguyen
(74) *Attorney, Agent, or Firm* — Venable LLP

(57) ABSTRACT

An image forming apparatus includes a printhead in which a plurality of element substrates for discharging a print material are arranged; a heating unit that maintains a temperature within the element substrate at a target temperature for each of the plurality of element substrates; a detection unit that detects the temperature within the element substrate for each of the plurality of element substrates; and a control unit that, for each of the plurality of element substrates, compares a highest temperature within the element substrate that is detected by the detection unit with a predetermined threshold, and if the highest temperature exceeds the predetermined threshold, sets the target temperature for the element substrate at a temperature which is higher than a target temperature set when the highest temperature does not exceed the predetermined threshold and lower than the predetermined threshold.

15 Claims, 11 Drawing Sheets

FIG. 5

| HB_No | 0 | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| HB_ENB | 0 | 0 | 0 | 0 | 0 | 1 | 1 | 1 | 1 | 1 | 0 | 0 | 0 | 0 | 0 |

IMAGE FORMING APPARATUS AND CONTROL METHOD THEREFOR

BACKGROUND OF THE INVENTION

Field of the Invention

The present invention relates to an image forming apparatus and a control method therefor.

DESCRIPTION OF THE RELATED ART

An image forming apparatus with a printhead has conventionally used heat to discharge ink when performing a print operation. Temperature control of the heat is performed in the printhead.

For example, Japanese Patent Laid-Open No. 2007-223144 discloses an arrangement of independently controlling an ink heater to achieve a set temperature in a heat unit configured to discharge ink.

However, in Japanese Patent Laid-Open No. 2007-223144, the target temperature of the entire head is set high based on a temperature detected by each head unit, so the power consumption is large. Further, in Japanese Patent Laid-Open No. 2007-223144, the highest temperature is set as the target temperature adjustment temperature of the entire head unit and the entire head undesirably stays in a high temperature state.

SUMMARY OF THE INVENTION

The present invention has been made to solve the above-described problems and performs appropriate temperature adjustment in a printhead while suppressing the power consumption.

According to one aspect of the present invention, there is provided an image forming apparatus comprising: a printhead in which a plurality of element substrates for discharging a print material are arranged; a heating unit configured to maintain a temperature within the element substrate at a target temperature for each of the plurality of element substrates; a detection unit configured to detect the temperature within the element substrate for each of the plurality of element substrates; and a control unit configured to, for each of the plurality of element substrates, compare a highest temperature within the element substrate that is detected by the detection unit with a predetermined threshold, and if the highest temperature exceeds the predetermined threshold, set the target temperature for the element substrate a temperature which is higher than a target temperature set when the highest temperature does not exceed the predetermined threshold and lower than the predetermined threshold.

According to another aspect of the present invention, there is provided a control method for an image forming apparatus including: a printhead in which a plurality of element substrates for discharging a print material are arranged; a heating unit configured to maintain a temperature within the element substrate at a target temperature for each of the plurality of element substrates; and a detection unit configured to detect the temperature within the element substrate for each of the plurality of element substrates, the method comprising: for each of the plurality of element substrates, comparing a highest temperature within the element substrate that is detected by the detection unit with a predetermined threshold, and if the highest temperature exceeds the predetermined threshold, setting the target temperature for the element substrate a temperature which is higher than a target temperature set when the highest temperature does not exceed the predetermined threshold and lower than the predetermined threshold.

According to the present invention, appropriate temperature adjustment can be performed in the printhead of an image forming apparatus while suppressing the power consumption.

Further features of the present invention will become apparent from the following description of exemplary embodiments with reference to the attached drawings.

BRIEF DESCRIPTION OF THE DRAWINGS

FIG. 5 is a table showing an example of the structure of a temperature adjustment enable HB setting table according to the present invention;

DESCRIPTION OF THE EMBODIMENTS

Figure 1:
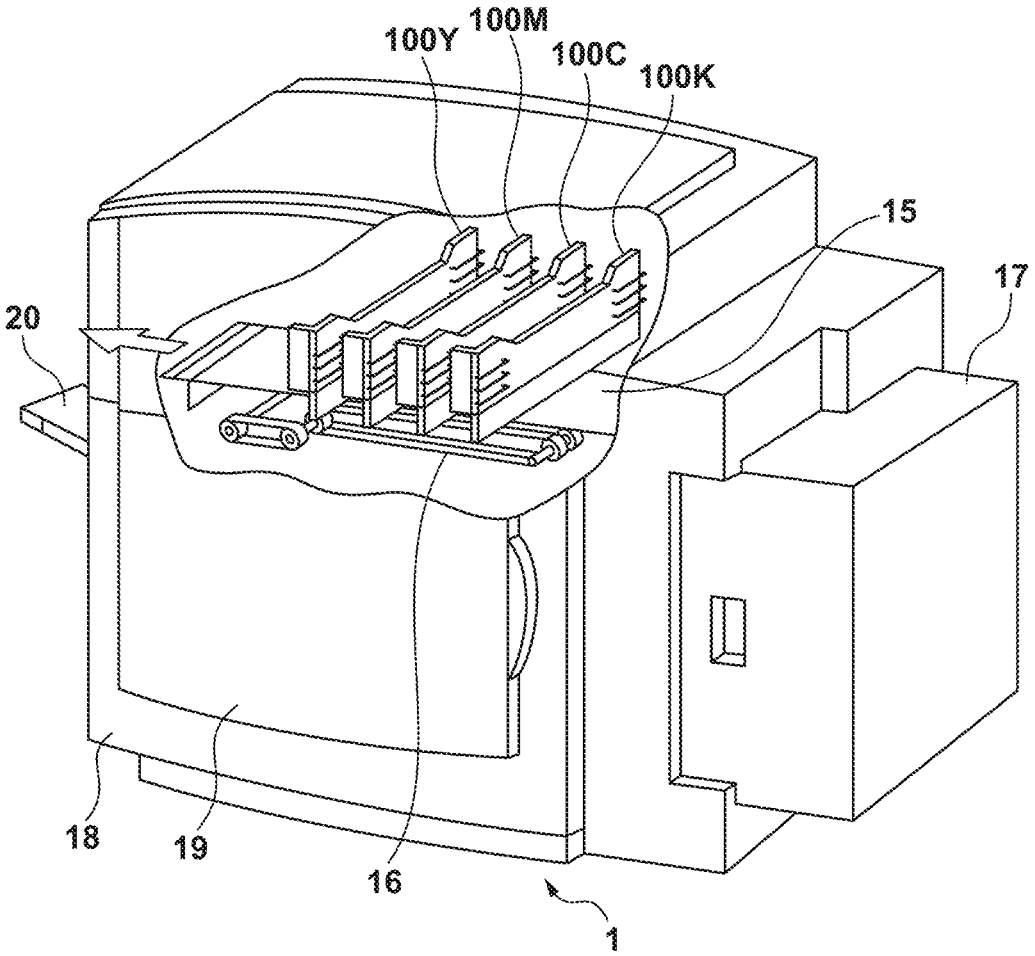
FIG. 1 is a perspective view showing an example of the outer appearance of an image forming apparatus according to the present invention.

Preferred embodiments of the present invention will now be described in more detail with reference to the accompanying drawings. The relative arrangement of constituent elements and the like described here may not be construed to limit the scope of the present invention to only them unless otherwise specified.

In this specification, the term "printing" (to be also referred to as "print" hereinafter) not only includes the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

In addition, the term "print medium" not only includes a paper sheet used in common image forming apparatuses, but also broadly includes materials, such as cloth, a plastic film, a metal plate, glass, ceramics, wood, and leather, capable of accepting ink.

Furthermore, the term "ink" (to also be referred to as a "liquid" hereinafter) should be extensively interpreted similarly to the definition of "printing (print)" described above. That is, "ink" includes a print material such as a liquid which, when applied onto a print medium, can form images, figures, patterns, and the like, can process the print medium, or can process ink (for example, solidify or insolubilize a coloring material contained in ink applied to the print medium).

Further, a "print element" generically means an orifice or a liquid channel communicating with it, and an element for generating energy used to discharge ink, unless otherwise specified.

Further, a "nozzle" generically means an orifice or a liquid channel communicating with it, unless otherwise specified.

A printhead element substrate (head substrate) used below means not merely a base made of a silicon semiconductor, but the arrangement of a printhead element substrate in which elements, wirings, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

An inkjet printhead (to be referred to as a printhead hereinafter), which is the most important feature of the present invention, is constituted by mouthing, on the same substrate, a plurality of print elements on the element substrate of the printhead and a driving circuit for driving these print elements. As will be apparent from the following description, the printhead adopts a structure in which a plurality of element substrates are incorporated and cascade-connected. This printhead can achieve a relatively long printing width. The printhead is used not only in a general-purpose serial image forming apparatus but also in an image forming apparatus with a full-line printhead whose printing width corresponds to the width of a print medium. The printhead is used in a large-format printer using print media of large sizes such as AO and BO among serial printing apparatuses.

First, an image forming apparatus using the printhead of the present invention will be described.

[Overview of Image Forming Apparatus]

FIG. 1 is a perspective view for explaining the structure of an image forming apparatus 1 which includes full-line inkjet printheads (to be referred to as printheads hereinafter) 100K, 100C, 100M, and 100Y and a recovery unit for always guaranteeing stable ink discharge.

In the image forming apparatus 1, a print sheet 15 is supplied from a feeder unit 17 to a print position by these printheads and conveyed by a conveyance unit 16 provided in a housing 18 of the image forming apparatus 1.

In printing an image on the print sheet 15, when the print sheet 15 is conveyed and the reference position of the print sheet 15 reaches a position under the printhead 100K that discharges black (K) ink, the printhead 100K discharges the black ink. Similarly, when the print sheet 15 reaches respective reference positions in the order of the printhead 100C that discharges cyan (C) ink, the printhead 100M that discharges magenta (M) ink, and the printhead 100Y that discharges yellow (Y) ink, the inks of the respective colors are discharged to form a color image. The print sheet 15 on which the image is thus printed is discharged and stacked on a stacker tray 20.

The image forming apparatus 1 further includes the conveyance unit 16, and ink cartridges (not shown) configured to supply the inks to the printheads 100K, 100C, 100M, and 100Y and replaceable for each ink. In addition, the image forming apparatus 1 includes, for example, a pump unit (not shown) for a recovery operation and ink supply to the printhead 100, and a control board (not shown) that controls the overall image forming apparatus 1. A front door 19 is an opening/closing door for replacing the ink cartridge.

[Control Arrangement]

Next, a control arrangement for executing printing control of the image forming apparatus 1 described with reference to FIG. 1 will be explained.

Figure 2:
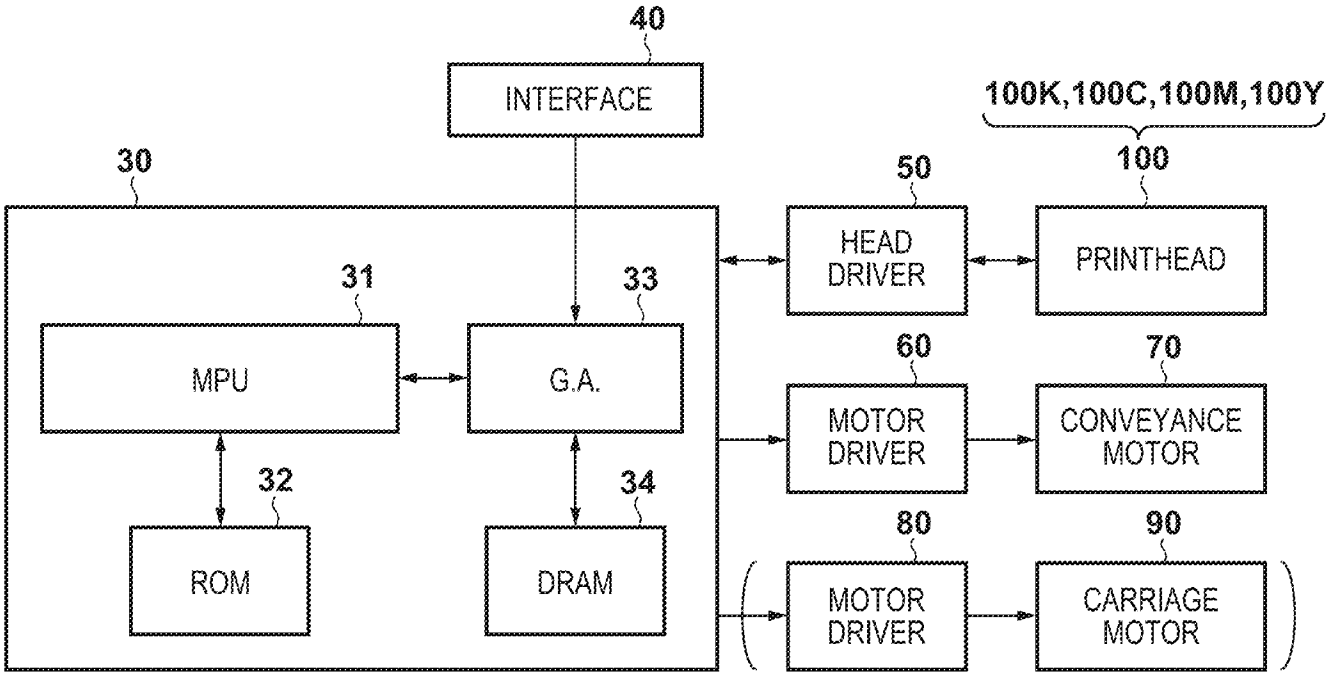
FIG. 2 is a block diagram showing an example of the control arrangement of the image forming apparatus according to the present invention.

FIG. 2 is a block diagram showing the arrangement of the control circuit of the image forming apparatus 1. In FIG. 2, a controller 30 includes an MPU 31, a ROM 32, a gate array (G.A.) 33, and a DRAM 34. An interface 40 is an interface for inputting print data. The ROM 32 is a non-volatile storage area and stores a control program executed by the MPU 31. The DRAM 34 is a DRAM for saving data such as print data and print signals to be supplied to the printheads 100. The gate array 33 is a gate array for controlling supply of print signals to the printheads 100, and also controlling data transfer among the interface 40, the MPU 31, and the DRAM 34. A carriage motor 90 is a motor for conveying the printheads 100 (100K, 100C, 100M, and 100Y). A conveyance motor 70 is a motor for conveying a print sheet. A head driver 50 drives the printheads 100. Motor drivers 60 and 80 are motor drivers for driving the conveyance motor 70 and the carriage motor 90, respectively.

Note that an image forming apparatus configured to use full-line printheads as shown in FIG. 1 adopts neither the carriage motor 90 nor the motor driver 80 for driving the motor. Hence, the motor driver 80 and the carriage motor 90 are parenthesized in FIG. 2.

The operation of the above control arrangement will be explained. When print data is input to the interface 40, it is converted into a print signal for printing between the gate array 33 and the MPU 31. Then, simultaneously with driving of the motor drivers 60 and 80, the printheads 100 are driven in accordance with the print data sent to the head driver 50, thereby performing printing.

Although a full-line printhead will be explained in the following example, the present invention is not limited to this and may be applied to a printhead for a serial image forming apparatus as described above.

First Embodiment

An embodiment of the present invention will be described below. In this embodiment, the printhead will be explained using a full-line printhead.

[Overview of Arrangement of Printhead]

Figure 3:
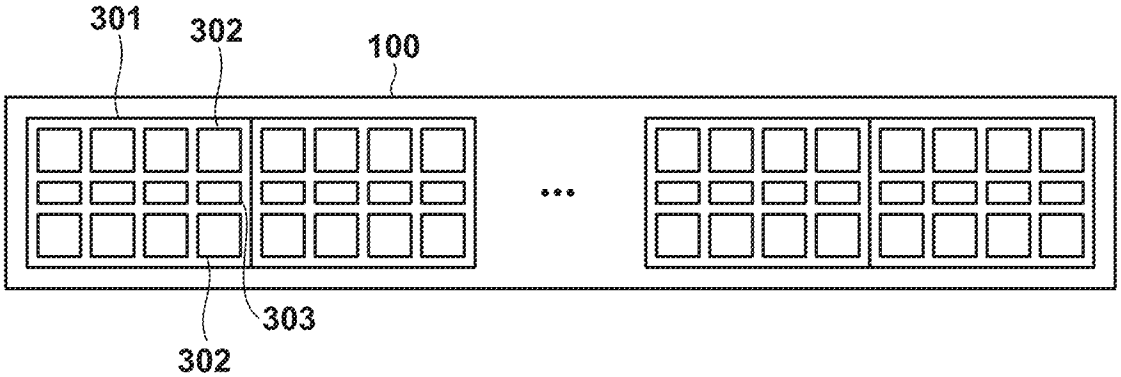
FIG. 3 is a view for explaining an overview of the arrangement of a printhead according to the present invention.

FIG. 3 is a view for explaining an overview of the arrangement of a printhead 100 according to this embodiment. As described above, a plurality of element substrates 301 are arrayed along the printing width in one printhead 100 according to this embodiment. That is, the plurality of element substrates 301 shown in FIG. 3 are arrayed in a direction (main scanning direction) perpendicular to the direction (sheet conveyance direction) of an arrow shown in FIG. 1. A plurality of sub-heaters (heat-up units) 302 are provided on one element substrate 301. Although the arrangement of the sub-heaters 302 is not particularly limited, they are arranged so that the provided sub-heaters 302 can adjust the temperature of the entire region of the corresponding element substrate 301. In this embodiment, the sub-heaters 302 are different from heaters provided in correspondence with respective nozzles for discharging ink.

In FIG. 3, the nozzles and the corresponding heaters are not illustrated. Temperature detection units 303 are provided on each element substrate. For example, a diode sensor can be used for the temperature detection units 303. The number of temperature detection units 303 and their arrangement are not particularly limited. By using the temperature detection units 303, temperature information on the corresponding element substrate 301 can be obtained. Note that the array and shape of the element substrates 301 are not limited to those shown in FIG. 3. For example, the shape of the element substrate may be a parallelogram or a trapezoid. The array of the element substrates may be formed from a plurality of lines or a staggered array.

When discharging ink from a nozzle, a driving pulse (driving signal) is input to a heater corresponding to the nozzle. A control signal to the sub-heater when performing temperature adjustment, and a driving signal to the heater when discharging ink are adjusted in real time based on a temperature detected by the temperature detection units 303. PWM (Pulse Width Modulation) control of switching the ON time (pulse width) of the pulse is performed on the driving pulse to the heater, thereby controlling the discharge amount of ink. When driving the heater, the same driving pulse having undergone PWM control is input to print elements arrayed on the same element substrate. Also, it is designed to, when driving a plurality of print elements on the same element substrate, input the same driving pulse and make constant the discharge amount of ink that is discharged by the same driving pulse in the same temperature environment. However, when the same driving pulse is input to drive a plurality of print elements on the same element substrate, amounts of ink discharged from the respective print elements differ in accordance with the temperature distribution of the element substrate including these print elements.

[Processing Sequence]

(Temperature-Retention Control)

Figure 4:
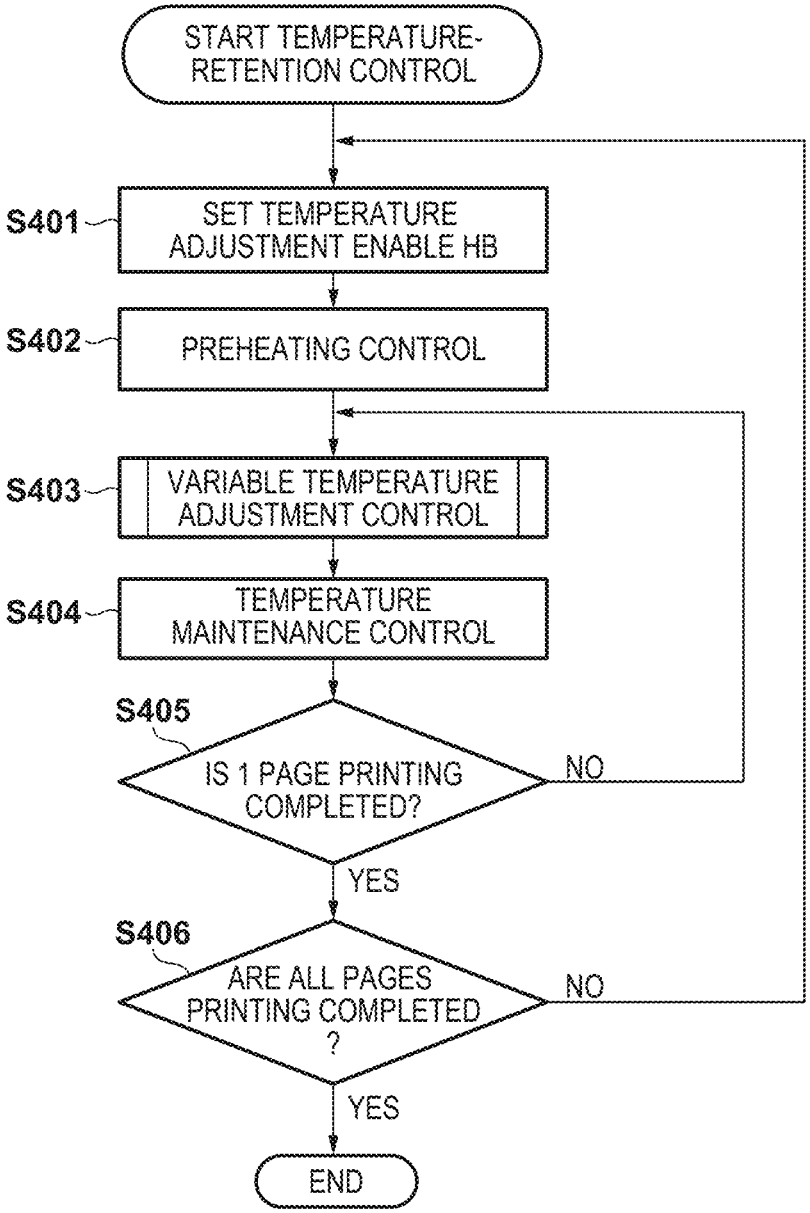
FIG. 4 is a flowchart showing overall temperature-retention control according to the present invention.

An overview of temperature-retention control according to this embodiment will be described. FIG. 4 is a flowchart showing overall temperature-retention control according to this embodiment. This processing sequence is implemented by, for example, reading out and executing a program stored in a ROM 32 or the like by an MPU 31. In the following description, the processing entity is the controller 30. This processing sequence starts along with the start of a print operation.

In step S401, a controller 30 sets a temperature adjustment enable HB. In this embodiment, the temperature adjustment enable HB is set using a temperature adjustment enable HB setting table shown in FIG. 5, and this table is stored in a DRAM 34 or the like. In FIG. 5, HB_No represents the number of each of element substrates (HB) provided in the printhead 100. This example assumes that 15 element substrates are arranged side by side in order along the printing width (main scanning direction) for one printhead, and "0" to "14" are sequentially assigned to the respective element substrates. The printing width direction is a direction perpendicular to the direction (sheet conveyance direction) of the arrow shown in FIG. 1. HB_ENB represents use or nonuse of each element substrate provided in the printhead 100. A value "1" means using a corresponding element substrate, and a value "0" means not using a corresponding element substrate. The example shown in FIG. 5 represents that element substrates from an element substrate of HB_No "5" at the left end to an element substrate of HB_No "9" out of all the 15 element substrates are used. In this embodiment, element substrates to undergo temperature-retention control are selected in accordance with a target sheet size for performing a print operation. For example, in the case of the postcard size, a region corresponding to five element substrates (HB) at the center out of the total printing width is used as a region for performing a print operation (to be referred to as a print operation region hereinafter), and temperature-retention control is executed for only these five element substrates. Although element substrates to be used are selected using the center of the printing width of the printhead as a reference, they may be selected using the left or right end as a reference.

In step S402, the controller 30 performs preheating control. In preheating control, for example, when discharge is not performed and supply of power regarding discharge (for example, supply of power to the heater) is not performed, the sub-heater (SH) is driven to reach a target temperature by supply of energy by which power for driving the sub-heater becomes smaller than a predetermined amount.

In step S403, the controller 30 performs variable temperature adjustment control. Details of this process will be described later with reference to FIG. 6.

In step S404, the controller 30 performs temperature maintenance control. In temperature maintenance control, for example, when discharge is performed and supply of power regarding discharge is performed, the sub-heater is driven to maintain the target temperature by supply of energy by which the sum of power supplied regarding discharge and power supplied to the sub-heater becomes smaller than a predetermined amount.

In step S405, the controller 30 determines whether printing of one page is completed. If the controller 30 determines that printing of one page is not completed (NO in step S405), the process returns to step S403. If the controller 30 determines that printing of one page is completed (YES in step S405), the process advances to step S406.

In step S406, the controller 30 determines whether printing of all pages is completed. If the controller 30 determines that printing of all pages is not completed (NO in step S406), the process returns to step S401. If the controller 30 determines that printing of all pages is completed (YES in step S406), this processing sequence ends.

(Variable Temperature Adjustment Control)

Figure 6:
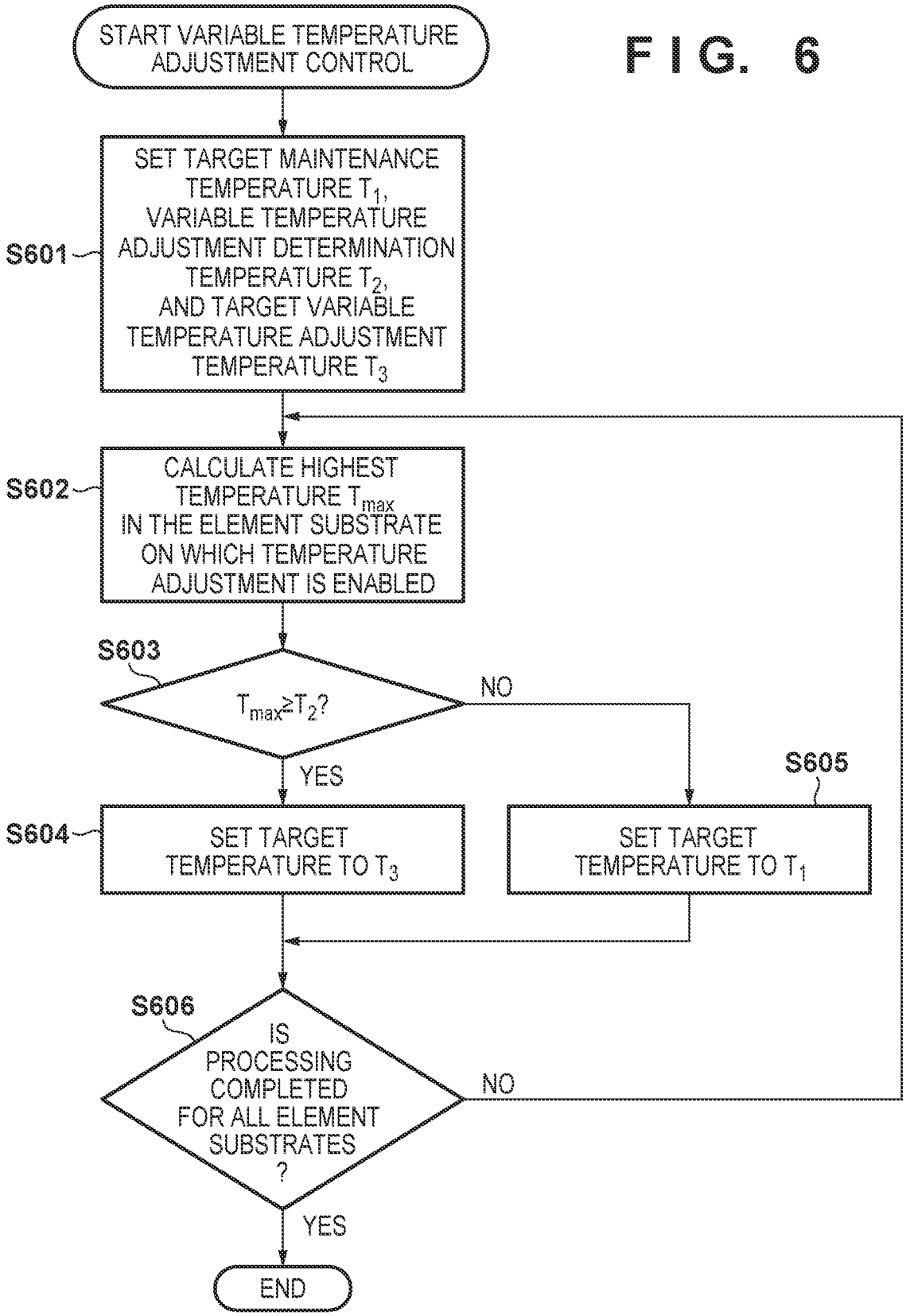
FIG. 6 is a flowchart showing variable temperature adjustment control according to the present invention.

FIG. 6 is a flowchart showing variable temperature adjustment control according to this embodiment, which corresponds to the process of step S403 in FIG. 4. Variable temperature adjustment control is processing of changing the target temperature of each element substrate in accordance with the temperature distribution of the printhead 100.

In step S601, the controller 30 sets a target maintenance temperature T1, a variable temperature adjustment determination temperature T2, and a target variable temperature adjustment temperature T3 (T2>T3>T1). The target maintenance temperature T1 represents the target temperature of the element substrate that is maintained to perform image formation, and is used as a default value. The variable temperature adjustment determination temperature T2 is a temperature for determining whether to change the maintained target temperature for the element substrate in this embodiment, and is used as a threshold. The target variable temperature adjustment temperature T3 is a target temperature used after changed from T1 when it is determined to change the maintained target temperature for the element substrate. In this embodiment, each temperature set here takes a common value for a plurality of element substrates, and this value is defined in advance and held in the ROM 32 or the like. The concrete relationship between the temperatures will be described later with reference to the drawings.

In step S602, the controller 30 selects one element substrate as a processing target from element substrates for which temperature adjustment is enabled. The element substrates for which temperature adjustment is enabled are specified by looking up the temperature adjustment enable HB setting table shown in FIG. 5. The controller 30 sets, as Tmax, the highest one of temperatures detected from the selected element substrates. The temperatures of the element substrates can be obtained by the temperature detection units 303 shown in FIG. 3.

In step S603, the controller 30 determines whether Tmax is equal to or higher than T2. If Tmax is equal to or higher than T2 (YES in step S603), the process advances to step S604. If Tmax is lower than T2 (NO in step S603), the process advances to step S605.

In step S604, the controller 30 sets the target temperature at T3. When the target temperature is set at T3, sub-heaters corresponding to a region where the temperature is lower than T3, out of a plurality of sub-heaters provided on the element substrate are driven until the temperature of this region reaches T3. In contrast, sub-heaters corresponding to a region where the temperature is equal to or higher than T3, out of the plurality of sub-heaters are driven to maintain the temperature of the corresponding region at T3. Then, the process advances to step S606.

In step S605, the controller 30 sets the target temperature at T1. The process then advances to step S606. When the target temperature is set at T1, sub-heaters corresponding to a region where the temperature is lower than T1, out of the plurality of sub-heaters provided on the element substrate are driven until the temperature of this region reaches T1. To the contrary, sub-heaters corresponding to a region where the temperature is equal to or higher than T1, out of the plurality of sub-heaters are driven to maintain the temperature of the corresponding region at T1.

In step S606, the controller 30 determines whether processing on all the element substrates for which temperature adjustment enabling is set is completed. If the controller 30 determines that processing on all the element substrates for which temperature adjustment enabling is set is completed (YES in step S606), this processing sequence ends. If an unprocessed element substrate remains (NO in step S606), the process returns to step S602 to set the unprocessed element substrate as a processing target and repeat the control.

By the above-described arrangement and processing sequence, the highest temperature Tmax of each of the element substrates is compared with a threshold T2. When Tmax is equal to or higher than T2, the target temperature is set at the temperature T3 lower than T2. For each of the element substrates, a target temperature that should be maintained by the element substrate is set in accordance with the highest temperature within the element substrate at that time. In other words, when the highest temperature within the element substrate drops, the target temperature that should be maintained by the element substrate is decreased. To the contrary, for example, in Japanese Patent Laid-Open No. 2007-223144 described as the conventional technique, a target temperature that should be maintained is set for all element substrates in accordance with an element substrate of the highest temperature among the plurality of element substrates. In the arrangement disclosed in Japanese Patent Laid-Open No. 2007-223144, even when the temperatures of some of the element substrates drop, the target temperature for all the element substrates is not decreased.

In the present invention, a target temperature is set for each of the element substrates to prevent the temperature (target temperature that should be maintained) of the entire printhead from staying high, unlike, for example, Japanese Patent Laid-Open No. 2007-223144, because of the difference of the target setting method. Also, in the present invention, temperature control is performed after setting the target temperature of an element substrate to be a temperature lower than the highest temperature within the element substrate. Therefore, power supplied to each element substrate can be suppressed to suppress the power consumption in the printhead, compared to an arrangement as disclosed in Japanese Patent Laid-Open No. 2007-223144.

Example

The feature of the present invention will be described in more detail in comparison with the conventional arrangement.

(Case of Conventional Arrangement)

An example of an operation in the conventional arrangement will be described with reference to FIGS. 7 to 9C. An example of controlling the target temperature of the element substrate as the constant target temperature T1 regardless of the temperature distribution within the element substrate will be explained as a related art to be compared with the present invention. In other words, the temperature is maintained so that the lowest temperature within the element substrate becomes the target temperature T1 regardless of the temperature distribution within the element substrate.

Figure 7:
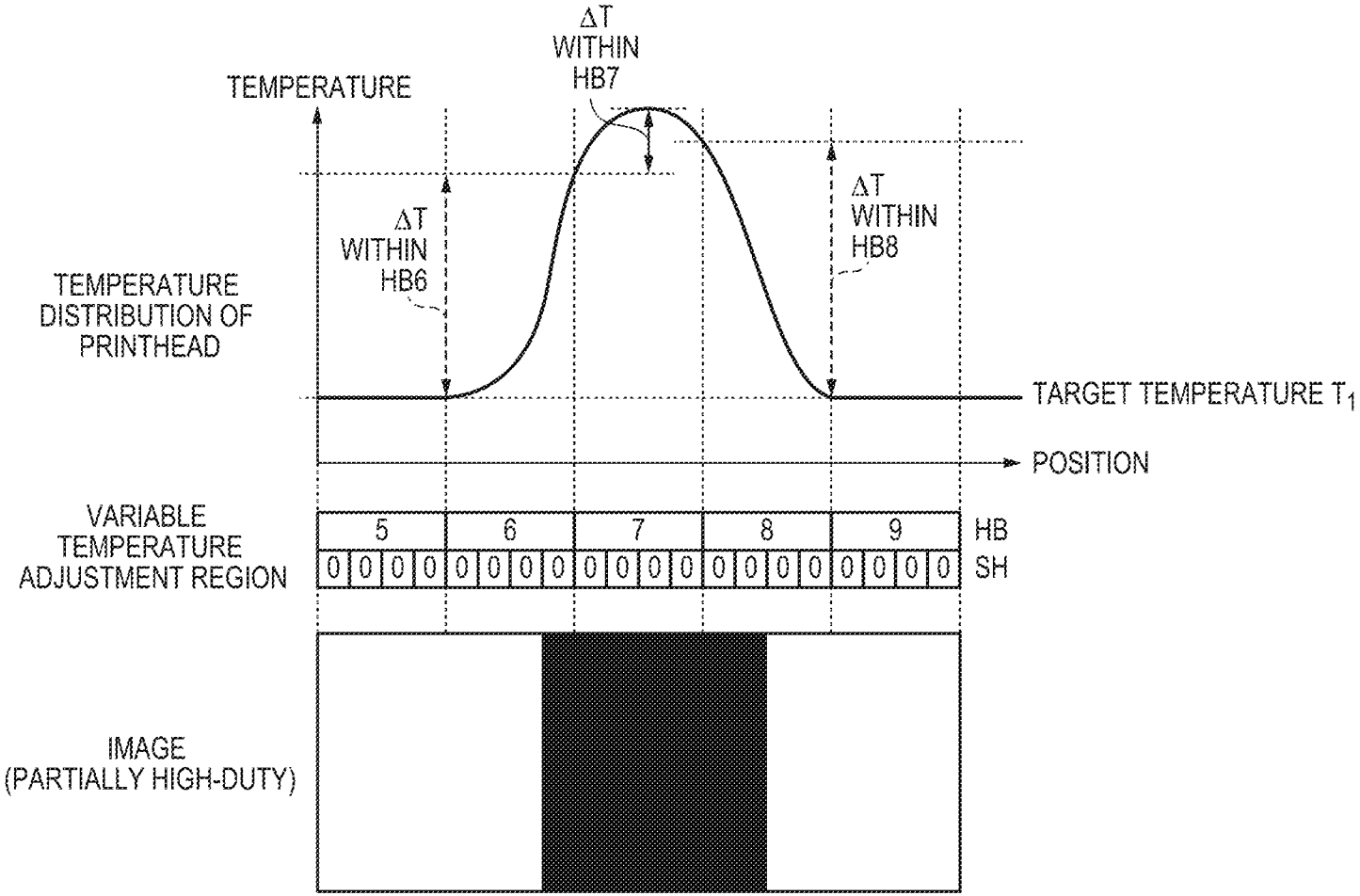
FIG. 7 is a view for explaining the temperature distribution of a conventional printhead.

FIG. 7 shows an example of the temperature distribution of a conventional printhead when a partially high-duty image is printed. An example of performing a print operation using five element substrates HB5 to HB9 out of a plurality of element substrates of the printhead is illustrated. One element substrate includes four sub-heaters. The high-duty image is, for example, an image of a high ink discharge density or a large discharge amount in image formation.

An upper stage in FIG. 7 shows the temperature distribution of the printhead in a range from the element substrate HB5 to the element substrate HB9. A middle stage in FIG. 7 shows a variable temperature adjustment region from the element substrate HB5 to the element substrate HB9. Here, "0" represents a region of the target temperature T1 or higher and "1" represents a region of lower than the target temperature T1. A lower stage in FIG. 7 shows a formation example of an image assigned to the element substrates HB5 to HB9. The temperature distribution of the printhead will be explained using an example in which a partially high-duty image is formed in the range from the element substrate HB5 to the element substrate HB9. In FIG. 7, a high-duty image is printed by part of the element substrate HB6, all of the element substrate HB7, and part of the element substrate HB8. At this time, the temperature of the print operation region rises and becomes equal to or higher than the target temperature T1, and sub-heaters corresponding to the print operation region are not driven. Note that the target temperature T1 is maintained even in the region of the element substrate HB5 or HB9 because the corresponding sub-heaters are driven at a timing when the temperature drops and becomes lower than the target temperature T1 due to heat radiation.

Figure 8:
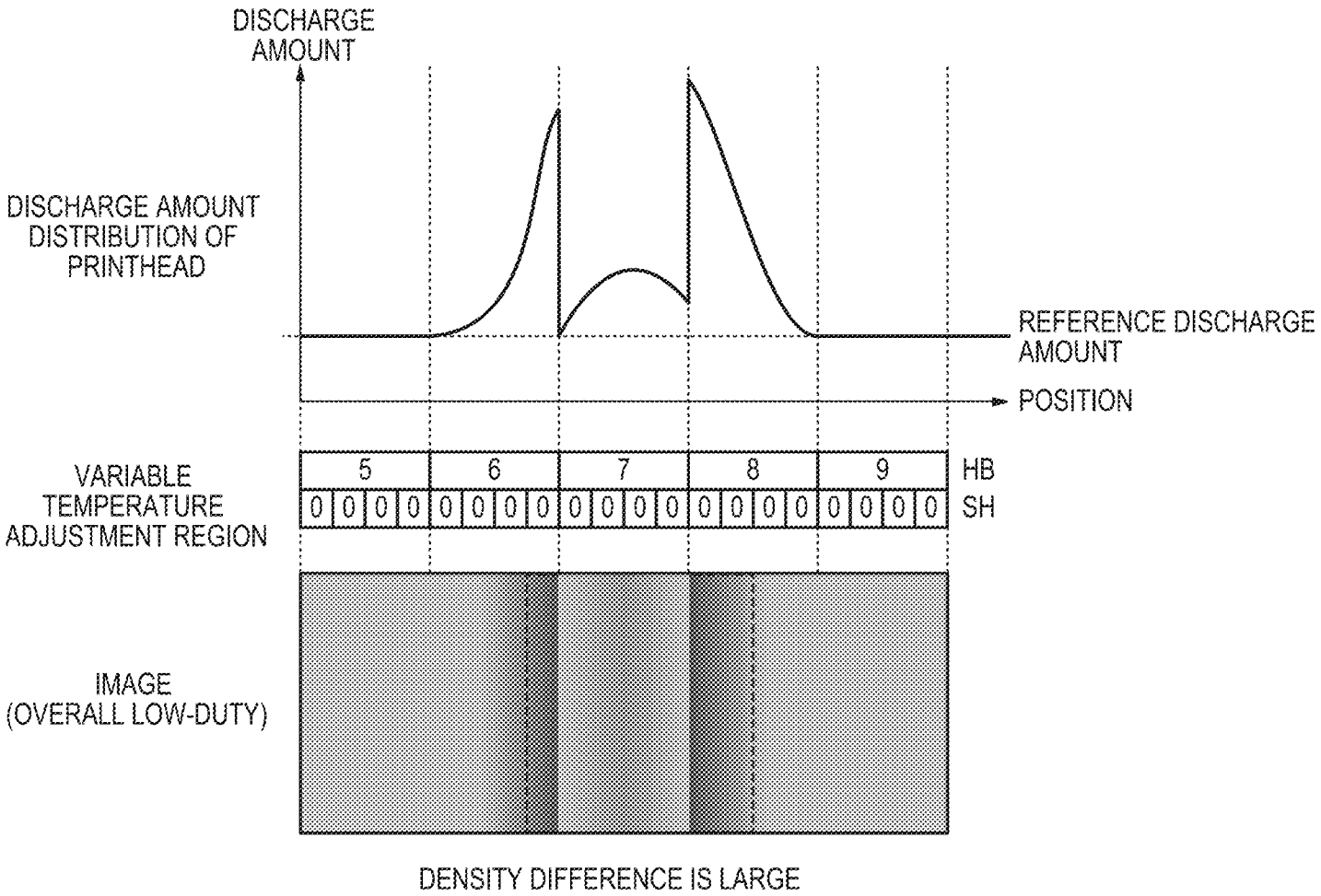
FIG. 8 is a view for explaining the discharge amount distribution of the conventional printhead.

FIG. 8 shows an example of the discharge amount distribution of the conventional printhead when the discharge amount of ink is adjusted in accordance with the temperature distribution of the printhead and then an overall low-duty image is printed. In this example, the discharge amount is adjusted on the element substrate HB7. In the example shown in FIG. 7, the lowest temperature of the element substrate HB7 is a temperature at the boundary between the element substrates HB6 and HB7, and a discharge amount at this temperature is adjusted to be a reference discharge amount. In contrast, the lowest temperature of each of the element substrates HB6 and HB8 coincides with the target temperature T1, so the discharge amount is not adjusted.

An upper stage in FIG. 8 shows the discharge amount distribution of the printhead in the range from the element substrate HB5 to the element substrate HB9. A middle stage in FIG. 8 shows a variable temperature adjustment region from the element substrate HB5 to the element substrate HB9. Here, "0" represents a region of the target temperature T1 or higher and "1" represents a region of lower than the target temperature T1. A lower stage in FIG. 8 shows a formation example of an image assigned to the element substrates HB5 to HB9. The discharge amount distribution of the conventional printhead will be explained using an example in which an overall low-duty image is formed in the range from the element substrate HB5 to the element substrate HB9. In FIG. 8, energy input to the element substrate HB7 is small so that discharge amounts corresponding to regions of lowest temperatures become equal between the element substrates. In this case, PWM control is performed on a driving pulse so that a discharge amount corresponding to the lowest temperature of the element substrate coincides with a predetermined reference discharge amount. More specifically, the ON time (pulse width) of the driving pulse to the heater is adjusted so that a discharge amount corresponding to the lowest temperature of the element substrate coincides with the reference discharge amount. Since the discharge amount difference within the element substrate or between the element substrates is large, the density difference upon printing an image (in this case, an overall low-duty image) becomes large. That is, a large density difference is generated within the image, as shown in the lower stage of FIG. 8. This causes generation of density unevenness and degradation of the image quality.

Figure 9A:
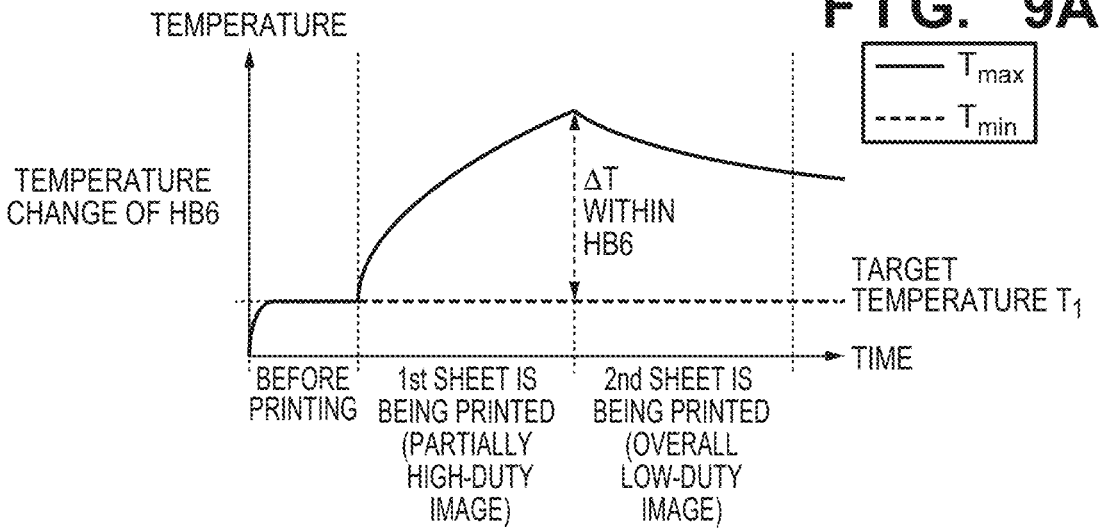
FIGS. 9A, 9B, and 9C are graphs for explaining the temperature change of the conventional printhead.
Figure 9B:
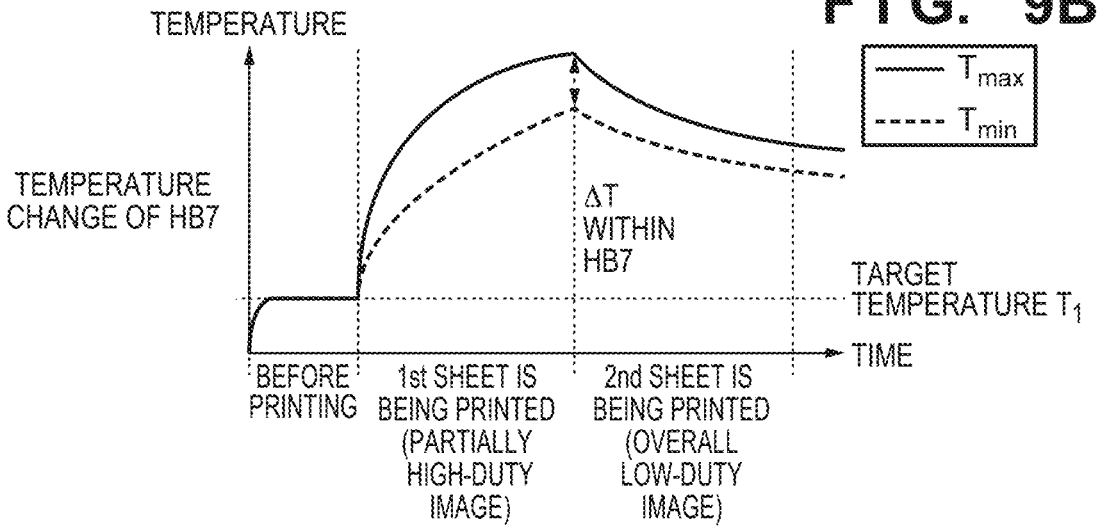
Figure 9C:
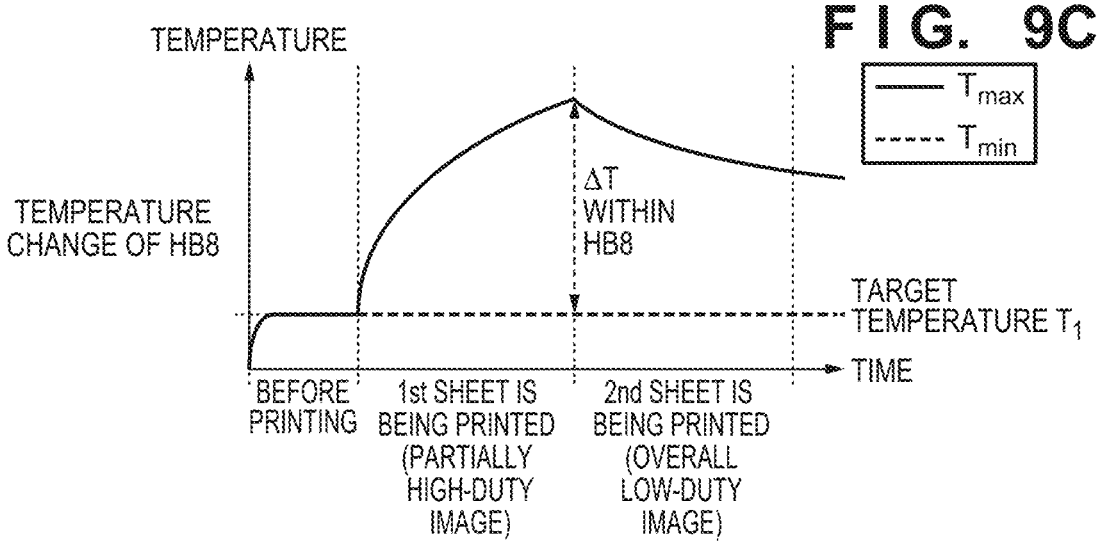

FIGS. 9A to 9C show an example of the temperature change of the conventional printhead when a partially high-duty image is printed on the first sheet and an overall low-duty image is printed on the second sheet. FIG. 9A shows the temperature change of the element substrate HB6. FIG. 9B shows the temperature change of the element substrate HB7. FIG. 9C shows the temperature change of the element substrate HB8. In the example of the conventional arrangement, the element substrates HB5 and HB9 during printing maintain the target temperature T1 and do not change, so an illustration of them will be omitted. Since the entire element substrate HB7 is used in printing, a temperature difference ΔT within the element substrate HB7 is smaller than the temperature difference ΔT within the element substrate HB6 or HB8. The highest temperature Tmax of each of the element substrates HB6 and HB8 is higher than the target temperature T1 and a lowest temperature Tmin is equal to the target temperature T1. For example, at the start of printing the second sheet (at the boundary between printing of the first sheet and printing of the second sheet), the temperature difference ΔT (=Tmax−Tmin) within each of the element substrates HB6 and HB8 is (Tmax−T1). For this reason, the density difference within each of the element substrates HB6 and HB8 becomes large. In the example of FIGS. 9A to 9C, the temperature difference ΔT within the element substrate HB7 is smallest and the temperature difference ΔT within the element substrate HB8 is largest.

Case of this Embodiment

An example of an operation in the arrangement according to this embodiment will be described with reference to FIGS. 10 to 12C.

Figure 10:
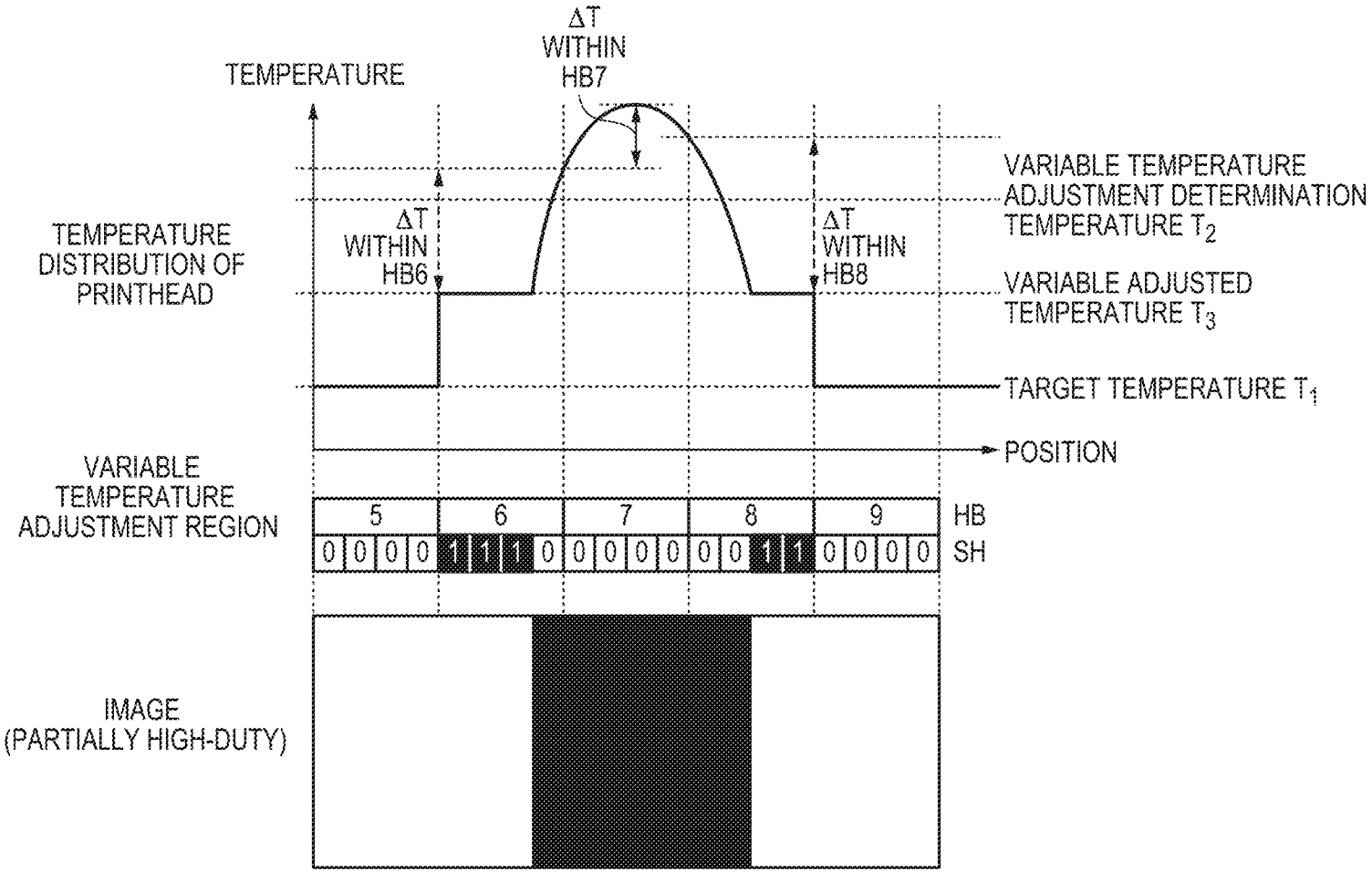
FIG. 10 is a view for explaining the temperature distribution of a printhead according to the first embodiment.

FIG. 10 shows an example of the temperature distribution of the printhead according to this embodiment when a partially high-duty image is printed. An upper stage in FIG. 10 shows the temperature distribution of the printhead from the element substrate HB5 to the element substrate HB9. A middle stage in FIG. 10 shows a variable temperature adjustment region from the element substrate HB5 to the element substrate HB9. Numbers shown in the middle stage of FIG. 10 correspond to the numbers in FIG. 5. Here, "0" represents a region of the target temperature T1 or higher and "1" represents a region of lower than the target temperature T1. A lower stage in FIG. 10 shows a formation example of an image assigned to the element substrates HB5 to HB9. Similar to FIG. 7, the temperature distribution of the printhead will be explained using an example of a partially high-duty image in the range from the element substrate HB5 to the element substrate HB9. In FIG. 10, a high-duty image is printed by part of the element substrate HB6, all of the element substrate HB7, and part of the element substrate HB8.

In this embodiment, as for the element substrates HB5 and HB9, the target temperature is set at T1 by the processing of FIG. 6 and "0" is set as the value of the variable temperature adjustment region based on comparison with T1. As for the element substrates HB6 to HB8, the target temperature is set at T3 by the processing of FIG. 6 and "0" or "1" is set based on comparison with T3. In the example of FIG. 10, the target temperature is set at T3 because the highest temperature of each of the element substrates HB6, HB7, and HB8 is equal to or higher than T2. When the temperatures of part of the element substrate HB6 and part of the element substrate HB8 are lower than the target temperature T3, sub-heaters corresponding to the respective element substrates are driven. At this time, the element substrate HB6 or HB8 can maintain the target temperature T3 because the sub-heaters are driven at a timing when the temperature drops and becomes lower than the target temperature T3 due to heat radiation.

Figure 11:
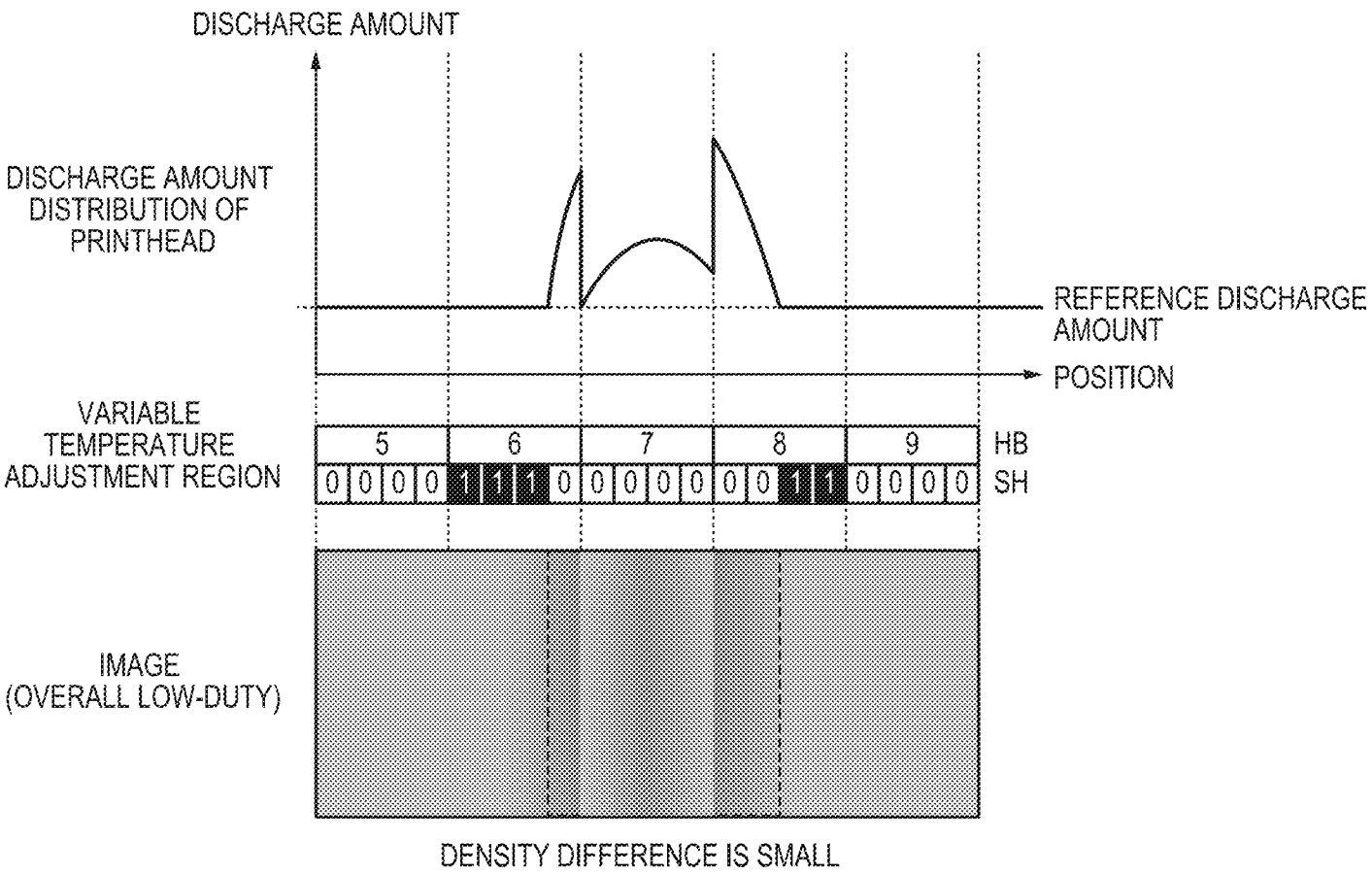
FIG. 11 is a view for explaining the discharge amount distribution of the printhead according to the first embodiment.

FIG. 11 shows the discharge amount distribution of the printhead according to this embodiment when the discharge amount of ink is adjusted in accordance with the temperature distribution of the printhead and then an overall low-duty image is printed. In this example, the discharge amount is adjusted on the element substrate HB7. In the example shown in FIG. 11, the lowest temperature of the element substrate HB7 is a temperature at the boundary between the element substrates HB6 and HB7, and a discharge amount at this temperature is adjusted to be a reference discharge amount. In contrast, the lowest temperature of each of the element substrates HB6 and HB8 coincides with the target temperature T3, so the discharge amount is not adjusted.

An upper stage in FIG. 11 shows the discharge amount distribution of the printhead in a range from the element substrate HB5 to the element substrate HB9. A middle stage in FIG. 11 shows a variable temperature adjustment region from the element substrate HB5 to the element substrate HB9. Numbers shown in the middle stage of FIG. 11 correspond to the numbers in FIG. 5. Here, "0" represents a region of the target temperature T or higher and "1" represents a region of lower than the target temperature T. A lower stage in FIG. 11 shows a formation example of an image assigned to the element substrates HB5 to HB9. The discharge amount distribution of the printhead will be explained using an example in which an overall low-duty image is formed in the range from the element substrate HB5 to the element substrate HB9. As described above, as for the element substrates HB5 and HB9, the target temperature is set at T1 by the processing of FIG. 6 and "0" is set as the value of the variable temperature adjustment region based on comparison with T1. As for the element substrates HB6 to HB8, the target temperature is set at T3 by the processing of FIG. 6 and "0" or "1" is set based on comparison with T3.

In FIG. 11, energy (PWM) input to the element substrates HB6, HB7, and HB8 is decreased so that discharge amounts corresponding to regions of lowest temperatures become equal between the element substrates. Since the discharge amount difference within the element substrate or between the element substrates is small, the density difference upon printing an image (in this case, an overall low-duty image) becomes small. That is, the density difference within the image is suppressed, as shown in the lower stage in FIG. 11, and generation of density unevenness and degradation of the image quality can be suppressed.

Figure 12A:
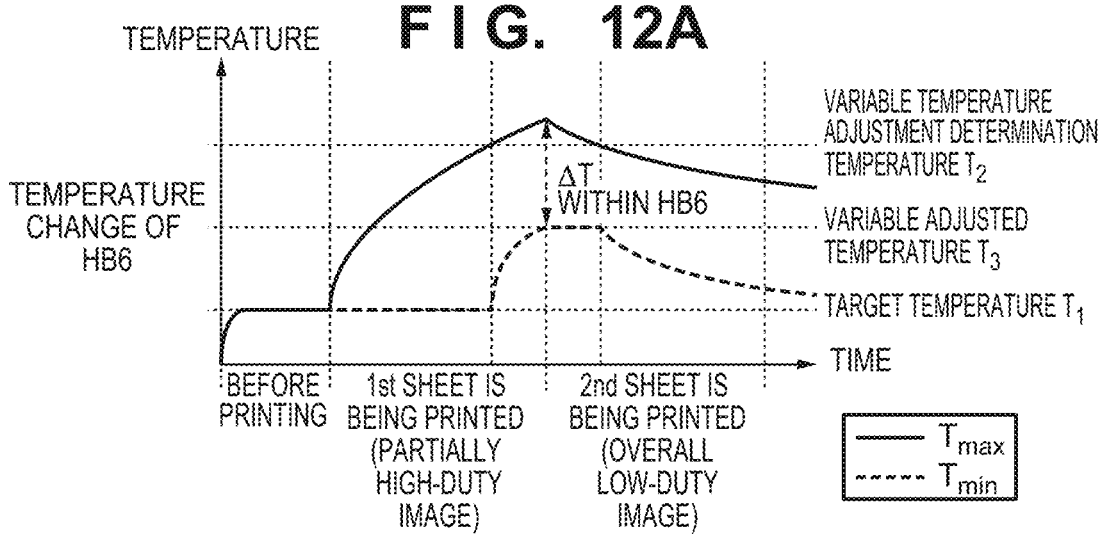
FIGS. 12A, 12B, and 12C are graphs for explaining the temperature change of the printhead according to the first embodiment.
Figure 12B:
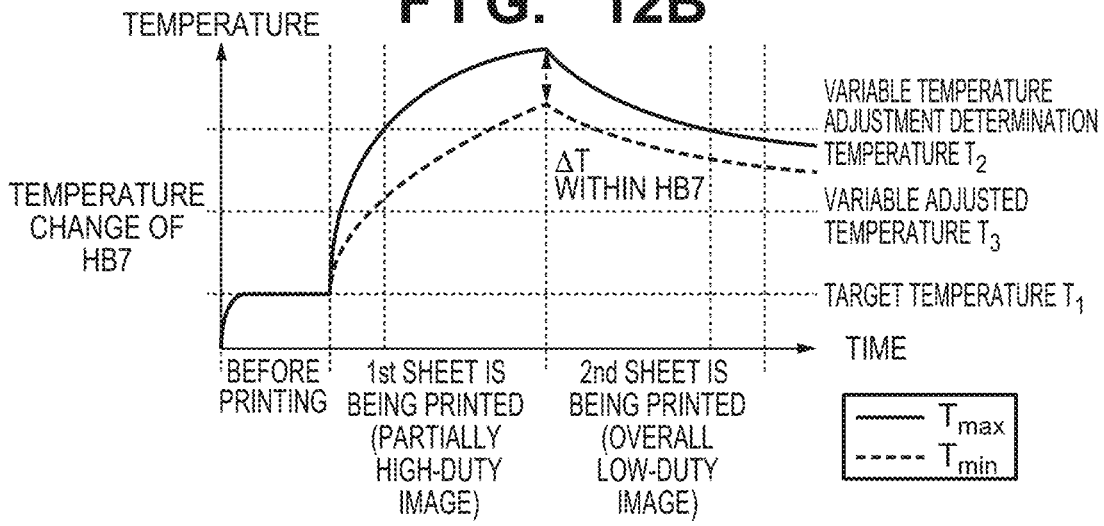
Figure 12C:
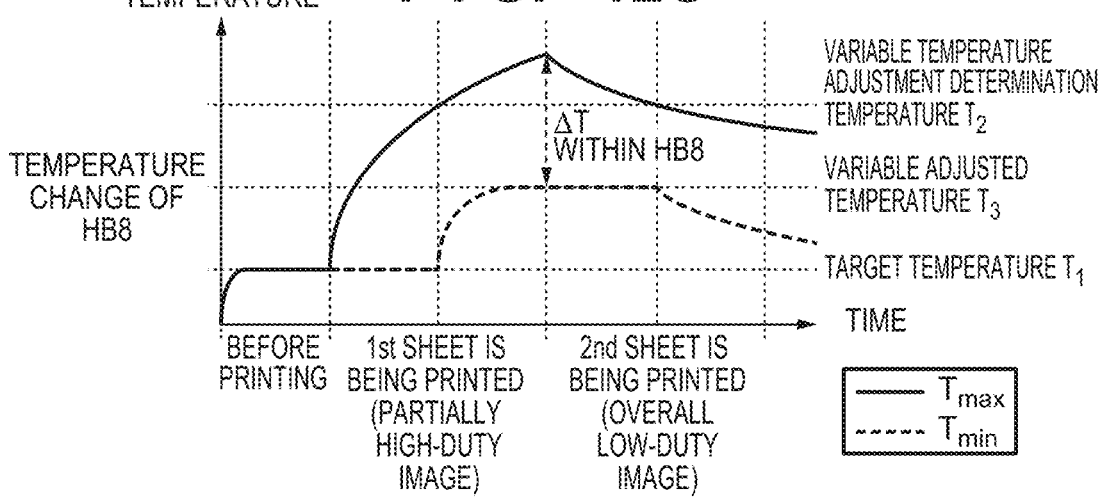

FIGS. 12A to 12C show an example of the temperature change of the printhead according to this embodiment when a partially high-duty image is printed on the first sheet and an overall low-duty image is printed on the second sheet. FIG. 12A shows the temperature change of the element substrate HB6. FIG. 12B shows the temperature change of the element substrate HB7. FIG. 12C shows the temperature change of the element substrate HB8. In this embodiment, as in the related art, the element substrates HB5 and HB9 during printing maintain the target temperature T1 and do not change, so an illustration of them will be omitted. Since the entire element substrate HB7 is used in printing, the temperature difference ΔT within the element substrate HB7 is smaller than the temperature difference ΔT within the element substrate HB6 or HB8. The highest temperature Tmax of the element substrate HB6 or HB8 is higher than the target temperature T1, and the lowest temperature Tmin is equal to or higher than the target temperature T1 and equal to or lower than the target variable temperature adjustment temperature T3. For example, at the start of printing the second sheet (at the boundary between printing of the first sheet and printing of the second sheet), the temperature difference ΔT (=Tmax−Tmin) within each of the element substrates HB6 and HB8 is (Tmax−T3). Because of T3>T1, (Tmax−T3)<(Tmax−T1) and the density difference within the element substrate becomes smaller than that in the conventional arrangement.

As described above, in this embodiment, when the highest temperature within the element substrate exceeds the threshold T2, the target temperature is set high and an increase in the temperature difference within the element substrate can be suppressed. As a result, the density difference within the element substrate becomes smaller than that in the related art using a constant target temperature. Even the density difference between the element substrates upon adjusting the discharge amount becomes smaller than that in the related art. This can reduce density unevenness caused by the temperature distribution of each element substrate of the printhead that is generated dynamically.

Since only sub-heaters at positions where the temperature is lower than the target temperature are selectively driven, the temperature distribution generated within each element substrate is relatively relaxed. Along with this, the power consumption of the element substrate can be suppressed.

Since the target temperature is set lower than the highest temperature Tmax within each element substrate, Tmax decreases and the target temperature T also decreases. This can prevent the temperature of the element substrate from staying high.

<Modification>

In the first embodiment, the variable temperature adjustment determination temperature T2 and the target variable temperature adjustment temperature T3 are treated as fixed values. However, they may be changed in accordance with the paper type (for example, glossy paper or plain paper). Glossy paper exhibits a larger density change with respect to a discharge amount change, compared to plain paper, and unevenness stands out. It is therefore preferable to set T2 and T3 for glossy paper to be lower than T2 and T3 for plain paper. The paper type may be determined based on print settings by the user, or a detection unit (not shown) for detecting a paper type may be provided.

The variable temperature adjustment determination temperature T2 and the target variable temperature adjustment temperature T3 may be changed in accordance with the paper width (for example, A3 size or A4 size). The power consumption of the sub-heater for A3-size paper is larger than that for A4-size paper, power used for discharge is small, and the temperature change of the printhead is small. Hence, it is preferable to set T2 and T3 for A3-size paper to be lower than T2 and T3 for A4-size paper. Note that the length (width) of a print medium in the main scanning direction has been exemplified, but the setting may be based on information about another size. The paper width (paper size) may be determined based on print settings by the user, or a detection unit (not shown) for detecting a paper size may be provided.

The variable temperature adjustment determination temperature T2 and the target variable temperature adjustment temperature T3 may be changed in accordance with the environmental temperature (for example, the ambient temperature is lower or higher than a predetermined threshold). The power consumption of the sub-heater at a low environmental temperature is larger than that at a high environmental temperature, power used for discharge is small, and the temperature change of the printhead is small. It is preferable to set T2 and T3 at a low environmental temperature to be lower than T2 and T3 at a high environmental temperature. At this time, the image forming apparatus is assumed to include a detection unit (not shown) for obtaining an ambient environmental temperature.

Other Embodiments

In the above-described embodiment, the target temperature is switched by one step (from T1 to T3). However, the present invention is not limited to this arrangement and the target temperature may be switched by two or more steps. As the difference of the target temperature is smaller, the temperature difference within the element substrate becomes smaller. Accordingly, the density difference within the element substrate becomes small. Ideally, it is preferable to set the target temperature at (Tmax−α) when Tmax is equal to or higher than (T1+α) (α is a positive constant), and set the target temperature at T1 when Tmax is lower than (T1+α). The α setting method is not particularly limited.

When a plurality of printheads corresponding to respective colors are arranged side by side, as shown in FIG. 1, different temperatures T1, T2, and T3 may be set for the respective printheads or the respective colors or types of inks.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-065496, filed Mar. 29, 2018, which is hereby incorporated by reference herein in its entirety.

What is claimed is:

1. An image forming apparatus comprising:

a printhead in which a plurality of element substrates for discharging a print material are arranged, each of the plurality of element substrates including at least one heating unit configured to maintain a temperature within the element substrate at a target temperature, and a plurality of detection units, each of which is configured to detect the temperature within the element substrates; and a control unit configured to set the target temperature for each element substrate and control the at least one heating unit for each element substrate, wherein the control unit is configured to set:

a first temperature as the target temperature if the highest temperature among temperatures detected by the plurality of detection units exceeds a predetermined threshold, and a second temperature lower than the first temperature as the target temperature if the highest temperature among temperatures detected by the plurality of detection units does not exceed the predetermined threshold.

2. The apparatus according to claim 1, wherein the predetermined threshold is higher than the first temperature.

3. The apparatus according to claim 1, wherein the predetermined threshold and the first temperature change in accordance with a type of print medium.

4. The apparatus according to claim 1, wherein the predetermined threshold and the first temperature change in accordance with a size of print medium.

5. The apparatus according to claim 1, wherein the predetermined threshold and the first temperature change in accordance with an environmental temperature of the image forming apparatus.

6. The apparatus according to claim 1, wherein each element substrate includes a plurality of heating units as the at least one heating unit, and each of the plurality of heating units heats a corresponding region within one element substrate.

7. The apparatus according to claim 1, wherein each of the plurality of detection units detects a temperature of a corresponding region within one element substrate.

8. The apparatus according to claim 1, further comprising a unit configured to, in every image formation on a print medium for each of the plurality of element substrates, control a discharge amount of the print material discharged at the lowest temperature among temperatures detected by the detection units to be a predetermined discharge amount.

9. The apparatus according to claim 1, further comprising a specifying unit configured to specify the highest temperature in temperatures detected by the plurality of detection units.

10. The apparatus according to claim 1, further comprising a storage unit configured to store the predetermined threshold.

11. A control method for an image forming apparatus including a printhead in which a plurality of element substrates for discharging a print material are arranged, each of the plurality of element substrates including at least one heating unit configured to maintain a temperature within the element substrates at a target temperature, and a plurality of detection units, each of which is configured to detect the temperature within the element substrates, the method comprising:

setting the target temperature for each element substrate; and controlling the at least one heating unit for each element substrate, wherein, in the setting, a first temperature is set as the target temperature if the highest temperature among temperatures detected by the plurality of detection units exceeds a predetermined threshold, and a second temperature lower than the first temperature is set as the target temperature if the highest temperature among temperatures detected by the plurality of detection units does not exceed the predetermined threshold.

12. The method according to claim 11, wherein the predetermined threshold is higher than the first temperature.

13. The method according to claim 11, wherein the predetermined threshold and the first temperature change in accordance with a type of print medium.

14. The method according to claim 11, wherein the predetermined threshold and the first temperature change in accordance with a size of print medium.

15. The method according to claim 11, wherein the predetermined threshold and the first temperature change in accordance with an environmental temperature of the image forming apparatus.

* * * * *